US006302037B1

(12) United States Patent
Del Frari

(10) Patent No.: US 6,302,037 B1
(45) Date of Patent: Oct. 16, 2001

(54) POSTURE STABILIZING DEMOUNTABLE COMPONENT TABLE SYSTEM

(76) Inventor: Paul J. Del Frari, 41 Windsong Pl., Meredith, NH (US) 03253

( * ) Notice: Subject to any disclaimer, the term of this patent is extended or adjusted under 35 U.S.C. 154(b) by 0 days.

(21) Appl. No.: 09/514,001

(22) Filed: Feb. 25, 2000

Related U.S. Application Data

(63) Continuation-in-part of application No. 08/953,917, filed on Oct. 20, 1997, now abandoned.

(51) Int. Cl.[7] ..... A47B 13/00

(52) U.S. Cl. ..... 108/157.16; 108/147.19; 297/174

(58) Field of Search ..... 297/135, 174; 108/50.11, 157.1, 144.11, 147.19, 150, 153.1, 161, 157.16

(56) References Cited

U.S. PATENT DOCUMENTS

| | | | |
|---|---|---|---|
| 2,601,177 | * | 6/1952 | Smullen . |
| 3,606,450 | | 9/1971 | Sedgwick . |
| 3,910,659 | * | 10/1975 | Peterson . |
| 4,566,732 | | 1/1986 | Ostergaard, II et al. . |
| 4,631,643 | | 12/1986 | Koster . |
| 4,679,509 | | 7/1987 | Samson, Jr. . |
| 4,878,685 | | 11/1989 | Bahm . |
| 5,181,681 | * | 1/1993 | Edwards . |
| 5,228,711 | | 7/1993 | Summers . |
| 5,697,668 | | 12/1997 | Chuan-Pan . |
| 5,711,572 | | 1/1998 | Khan . |

OTHER PUBLICATIONS

Gaylor School & Office Furniture Catalog 1999 p. 479.
Demco Catalog 1999 p. 709.

* cited by examiner

*Primary Examiner*—Milton Nelson, Jr.
(74) *Attorney, Agent, or Firm*—Scott J. Asmus; Vernon C. Maine

(57) ABSTRACT

A demountable component table system to improve handicapped access to standard proportioned furnitures common to public places. A table top component has symmetrically positioned cut-outs for foam rubber covered, demountable flexible steel rods to pass from their frame component sockets upwards to the area above the top component where they provide upper body and arm support for occupant utilization and management of the cubic space above the table top. Frame mounted rods with Velcro attachments and a vertically mounted rigid tubular pole which inserts through the table top component into its socket mount in the table frame allow for customized positioning of objects in the cubic space above the top. The front side edge of the top component is cantilevered towards the occupant's chest. Varied types of demountable legs allow for height adjustment in inch increments. The combination of cantilevering and height flexibility makes the full length of the longitudianal midline of its substantial flat surface top accessible to a juvenile's range of motion. The system's frame supports multi-directional lighting. The system is used in full or partial forms. Full form is when its frame and top components are independently supported by system legs. Partial forms are when the frame and top are fully or partially supported by the rigid surface of other furniture and combinations of system legs. Occupants gain access to standard furniture through use of the system's frame and top components.

19 Claims, 12 Drawing Sheets

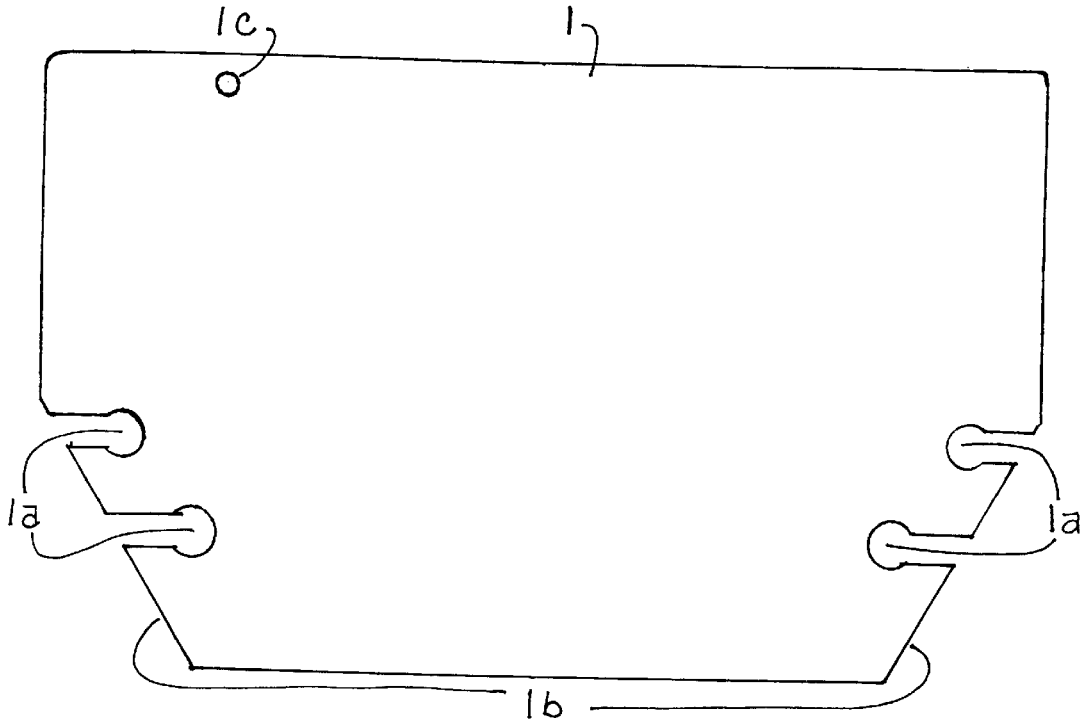
FIGURE 2
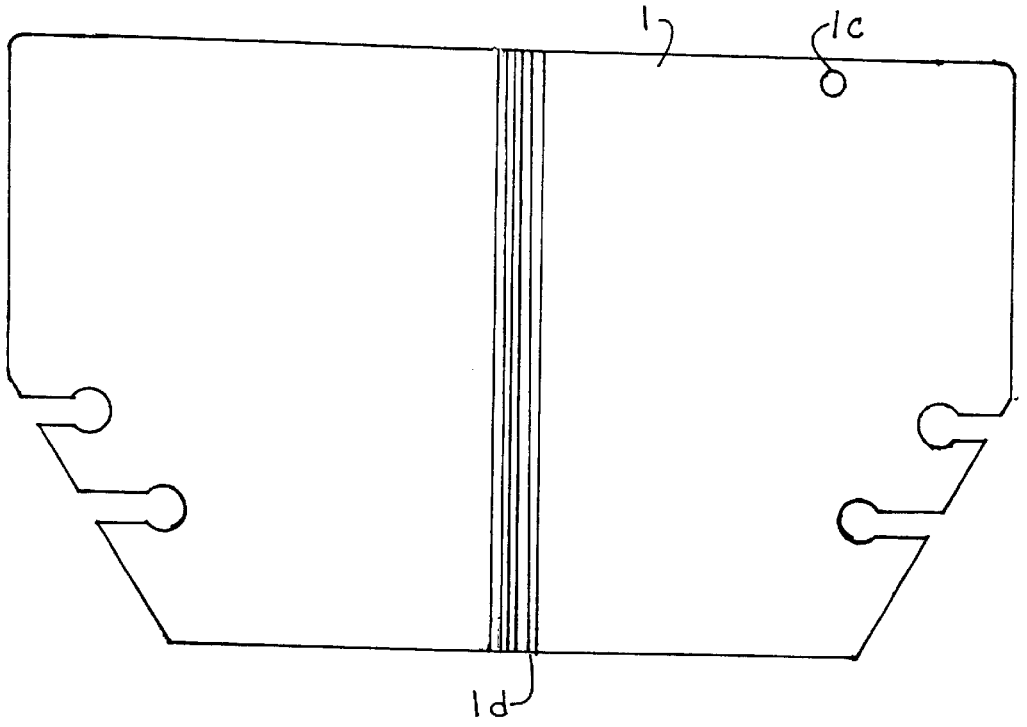

POSTURE STABILIZING DEMOUNTABLE COMPONENT TABLE SYSTEM

CROSS-REFERENCE TO RELATED APPLICATIONS

The present application is a Continuation-in-Part (CIP) of Parent patent application Ser. No. 08/953,917 filed Oct. 10, 1997, now abandoned.

FIELD OF THE INVENTION

This invention relates to a table system to aid individuals dependent on orthopedic seating to maintain stable posture for observing, working, and being independent in their environment. It is useful in the fields of physical therapy, occupational therapy, orthopedics, nursing, education, rehabilitation, and geriatrics.

BACKGROUND OF INVENTION

The Individuals With Disabilities Act of 1990 guaranteed full access to the community for the disabled; a process described in education and rehabilitation literature as inclusion.

One barrier to public access is the inability of people who require orthopedic seating to use standard size and design furniture. Prescription orthopedic seating, prescription wheelchairs, are required by many disabled individuals. These chairs are molded and fitted to an individual's hip and spine support needs. To take advantage of a seat's postural control the user's back must be and remain adjacent to the chairback. Restraints such as seatbelts, crotch pommels, wrap-around headbands, and foot straps keep the body elevated and the back in contact with the chairback.

The circumstance of standard design table framing often blocks the lateral side supports of wheelchairs and prevents chair access to the space underneath the table. U.S. Pat. No. 4,566,732 to Ostergaard, II et al, Jan. 28, 1986 explains that even "if the wheelchair can be brought into close proximity with the table, very often it is found that, due to the chair's dimensions, the occupant is seated too low to reach the table surface conveniently. The problem is increased in magnitude when the occupant is either a small child or is a person having limited upper body mobility." This situation makes an extended reach necessary to get to the table surface of conventional furniture. Extended reaching pulls a wheelchair bound person's back away from his/her chair. This prompts fighting the restraints and forfeiting chair supports to get hands and head nearer to where stimulation is, to be responsive to social engagement and not be isolated.

Prior art inventions that attempted to solve the problem of mounting a table or tray surface to the wheelchair are described in U.S. Pat. Nos. 4,878,685 3,606,450, and 5,228,711, that illustrate wheelchair mounted solutions to this challenge.

Alternately, U.S. Pat. Nos. 4,679,509 and 5,711,572 disclose inventions that depart from the wheelchair mounting of a substantial work surface to a separate wheelchair table and foldable table with foldable chair combination respectively.

U.S. Pat. No. 5,697.668 to Chuan-Pao on Dec. 16, 1997 discloses an invention intended to solve the problem of presenting a substantial flat work surface "to a wide variety of builds of users" in a standard furniture desk chair structure.

U.S. Pat. No. 4,631,643 to Koster, Detlef on Dec. 23, 1986 discloses a demountable multi-purpose light table which presents a height adjustable, substantial work surface with variable intensity lighting housed within the table framing. However, the forward wheels of orthopedic seating are blocked from rolling under the table by framing bars which join the side legs of the table.

Standard practice in the field of assistive technology includes individualized fitting of prescription wheelchairs with rigid sheet trays. These trays make no accommodation to access the use of standard furniture, no accommodation to the use of low-intensity lighting. They have unintentional effects such as tilting along with the wheelchair they are attached to even when a horizontal work surface is desirable.

Adaptive furniture designs include supports called "prone-standers" which are large, rectangular steel frame housings for complete body support from feet to head to hold a person erect and facing a table, typically once which has been slaved to the body support apparatus. This standard practice design suffers from defects in that: the size of the structural framework needed to combine full body support with a table requires significant square footage; this competes with the space needs of others in a classroom or recreation room; the weight of prone-stander type equipment requires it to be on coasters and therefore to occupy aisle space.

Wheelchair accessible public access workstations are advancement. They allow adult size wheelchairs to pass under the table surface part of the workstation. Lowest table height settings vary but work surface height of all workstations prohibits their use by young children. Workstation framing interferes or prohibits with the line of sight in the direction the occupant is facing; their rigid frame height blocks the sightlines of others in the user's environment.

Search of patent and commercial prior art shows employment of features used in my invention: cantilevering of the front side edge of a table top towards the user, underlighting to remove shadows and highlight the form of objects on the table's surface, presentation of an adjustable, substantial work surface to a disabled individual, and flexible height adjustment. No prior art employing all these features in combination was found.

More important to this invention no evidence of the use of table frame mounted, flexible position support for upper body and head posture in the cubic space above a substantial work surface was found.

Additionally, no evidence of table frame mounted supports of variable degrees of resistance to pressure from body movements and weight was found.

Additionally, no evidence of any invention or product featuring table frame mounted support for body movements and posture in the cubic space above a substantial work surface which may be customized to a specific task or disability was found.

Additionally, no invention employing the combination of a table frame mounted rigid pole for holding large objects in the cubic space above a substantial work surface in combination with a plurality of position, length, and resistance variable supports for objects and body posture in the cubic space above a substantial work surface was found.

Additionally, no invention that provided full upper body posture support and task organization assistance in a manner that facilitates user access to the standard furniture common to public places was found.

Limitations in prior art recommends a table system which has the following characteristics: a) a substantial flat surface in conjunction with height adjustability for juvenile to adult sized seating b) a means of assisting people to manage and use the cubic space above substantial flat surface areas c) a means of providing multi-directional lighting to the cubic space above a substantial flat surface d) a means of providing the advantages of a, b, and c in a manner that integrates the handicapped individual into the mainstream of activity by providing the customized support they need along with access to furnitures of standard design and proportions in a way that doesn't exhaust the square footage resources of a room.

SUMMARY OF THE INVENTION

My invention meets these objectives through a demountable component table system comprised of lightweight components, which assemble into varied configurations depending upon how the system's table frame component is used.

Four rectangular block table frame corners, the top one third of which are uniform in size and shape, connect with parallel framing bars at these equal upper segments thereby forming a rectangular enclosure supported by the lower portions of the block shaped corners; this is the base of the table's demountable frame.

A plurality of sockets are fastened to and housed within the four table frame corners. Demountable table system components connect to the table frame through these sockets.

Demountable system components include a plurality of different types of height adjustable table legs; foam rubber covered pliable or flexible steel rods which extend upwards from their frame corner sockets to the surface area above the tabletop by passing through cutouts of a cul-de-sac design in the table's demountable rigid surface top; a vertically oriented tubular rod inserted into its frame corner socket by passing down through the rigid surface tabletop at a cutout positioned directly over the table frame corner which houses its socket.

A light-diffusing, demountable rigid surface top of symmetrical design is transversely hinged at midline from its front side edge to its rear side edge. This foldable table top presents and easy to demount, transport, and remount substantial flat table surface.

The aforementioned cul-de-sac design tabletop cutouts are bilateral and align with the table frame's front corners so that foam rubber covered rods can be inserted into the table frame sockets and then manipulated through these cutouts to the cubic space above the tabletop surface where they can be shaped to serve the table's user in individually customized ways.

Suspended from the mid-section area of the lengthwise sides of the rectangular table frame base component and transversing the width of the enclosure is a "U" shaped plastic covered wire mesh enclosure; this is the outer housing for a sheet of lightweight rigid material which serves as a recessed platform for low wattage, portable florescent light fixtures. Fixture cords insert into a three plug polarized outlet that is housed under one of the widthwise parallel bars of the rectangular frame.

The wire mesh enclosure extends downward from the bottom surface of the rectangular frame a distance equal to that which the table's four corners extend down from the rectangular frame's underside. Thus the table frame can be placed on another piece of furniture and be stable, supported by the flat plastic coated mesh and the bottoms of the four frame corners. In this manner the table frame can support its demountable light diffusing top and all of its demountable features without need of any of its height adjustable legs.

The rigid surface tabletop employs a tapir design on its left and right sides towards its front edge which cantilevers towards the table user. "L" shaped brackets attached to the slotted front side of the rectangular frame serve as cantilever supports for the tabletop. Tapering of the table top sides allows for people to be next to, at the shoulder of, the table occupant while maintaining a large lateral work surface for the occupant in the untapered section of the demountable top. The combination of height adjustablility and cantilevering gives access to the full longitudinal midline of the tabletop by a juvenile's range of motion.

A plurality of table leg forms all have the same outside diameter at their tops where they insert into the table's corner leg sockets. The system includes adjustable length telescoping legs and step legs of varying lengths. Leg types can be used individually or in combinations. The table frame may be supported by a pair of step legs inserted into its rear corners which extend down as column supports to a surface higher that the floor; in combination with a pair of telescoping legs inserted into its front corners which extend downward a further distance to the floor. In this manner the table can be positioned over another piece of furniture giving its user access to the furniture it partially rests upon along with all of the system's supports.

BRIEF DESCRIPTION OF THE DRAWINGS

FIG. 10*a* top view of corner's interior fastener seats and sills attaching cul-de-sac segments of table brackets to the independent front corner, secured to the corner they function as sockets for slideable couplings as when table mounted.

REFERENCE NUMERALS TO DRAWINGS

1 demountable rigid surface tabletop

1*a*—bilateral cul-de-sac design cutouts, 1*b*—symmetrical taper of right and left sides toward front, 1*c*—cut out for rigid rod insert through tabletop, 1*d*—transparent hinge,

2 demountable table frame

2*a*1—right front side table frame corner, 2*a*2—left front side table frame corner, 2*a*—rod sockets found on front left and front right side table frame corners, 2*b*—rear corner table frame sockets, 2*c*—"L" shaped brackets attached to slotted front side of framing bar, brackets also support a cul-de-sac cut-out which aligns with the cul-de-sac cutout of tabletop, 2*d*—side bracket, a support for demountable tabletop component, table frame handles labeled 2*e,* and for cul-de-sac cutouts aligned with cul-de-sac cutouts in table top, 2*f*—threaded aperture for spring loaded pin to push against table leg and prevent leg from slipping when table is moved, 2*g*—lessor diameter ring at corner top to stop leg from extending through to table top, 2*h*—apertures for fasteners to secure corners to framing bar components, 2*i*—sills that support system components fastened to the corners and prevent them from rotating,

3 foam rubber covered pliable steel rods

3*a*—slideable coupling: secures rod to table frame when seated in aligned cul-de-sac cut-outs of table top and frame mounted brackets, 3*a*1—ringed top section of slideable coupling which assists grasping and is of a larger diameter than the circular portion of the cul-de-sac cutouts, 3*a*2—bottom section of slideable coupling which is of a lessor diameter than the ringed coupling top 3*b*—fixed angle bends adhered to rods, 3*c*—varied types of foam rubber adhered to rods to customize their function and position, 3*d*—Velcro straps attached to rods, primary means of attaching rods to supports in addition to those provided by table frame,

4 table legs

4*a*—ring stop to prevent slideable inner section from passing through outer leg segment on telescoping legs, 4*b*—lock pin to fix telescoping leg length at selected height, 4*c*—step legs of variable lengths,

5 rigid pole for vertical support of heavy objects over the tabletop

5*a*—stop to limit rigid rod descent into corner leg socket,

6 wire mesh outside housing for portable florescent fixtures

6*a*—joists to support mid-section of demountable tabletop, 6*b*—low wattage portable florescent fixtures, 6*c*—Velcro stripping which tethers florescent fixtures to the rigid platform they attach to, 6*d*—fastener to attach joists to slotted sides of rectangular base frame, 6*c*—fastener that secures plastic coated wire mesh housing to the bottom slot of framing bar of rectangular base frame, 6*f*—rigid surface material used as platform base of wire mesh enclosure,

7 three plug polarized electric outlet secured to rectangular table frame at rear corner

8 wire carrier fastened to interior slot of framing bar

DETAILED DESCRIPTION OF THE INVENTION

Figure 3:
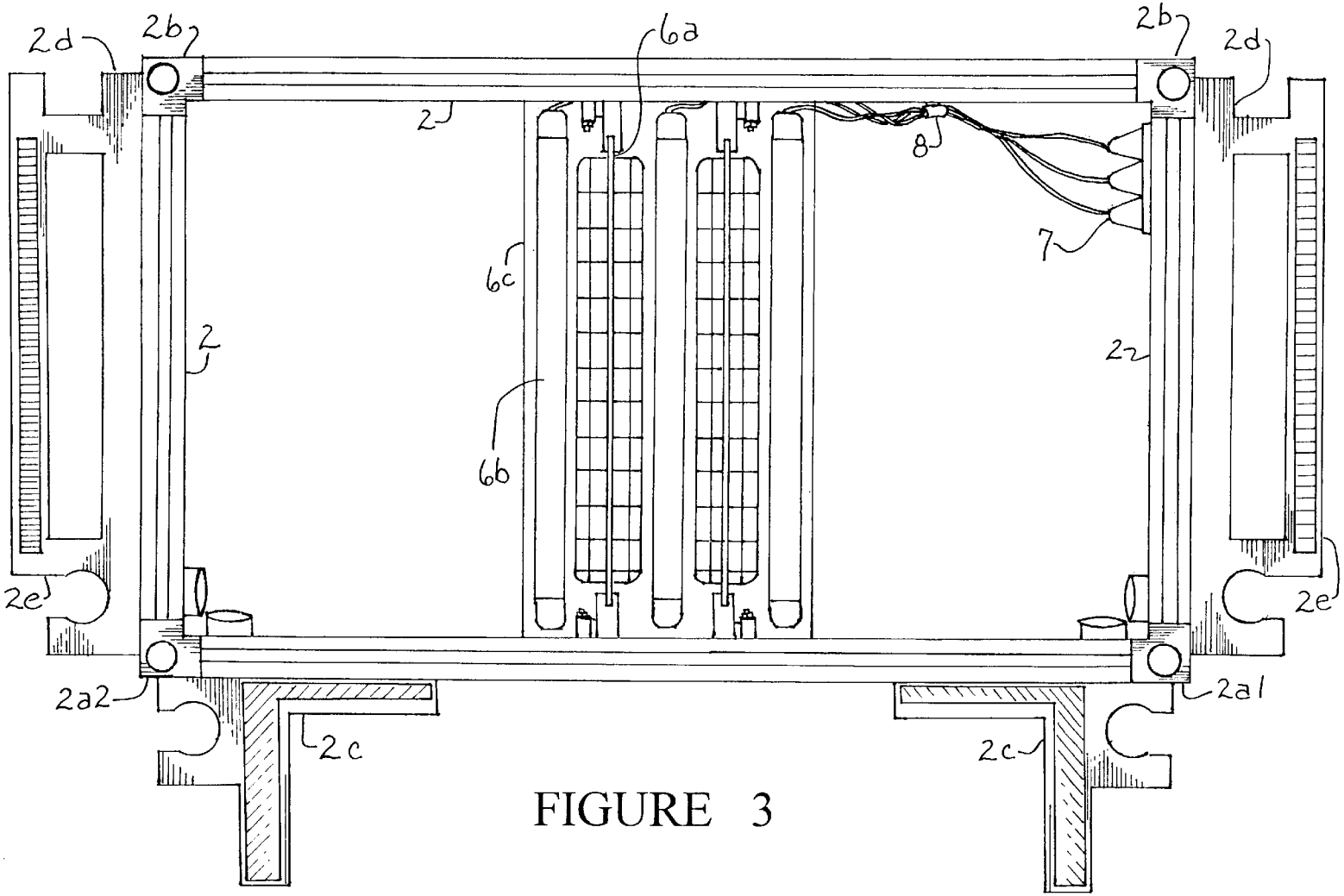
FIG. 3 top view of demountable table frame.

Four block shaped rectangular corners are the structural base for the demountable table frame and for the sockets demountable system components will be attached to and released from: 2*a*1, 2*a*2, 2*b,* and 2*b* in FIG. 3 show the four corners framing bars, 2 connect with.

Figure 7:
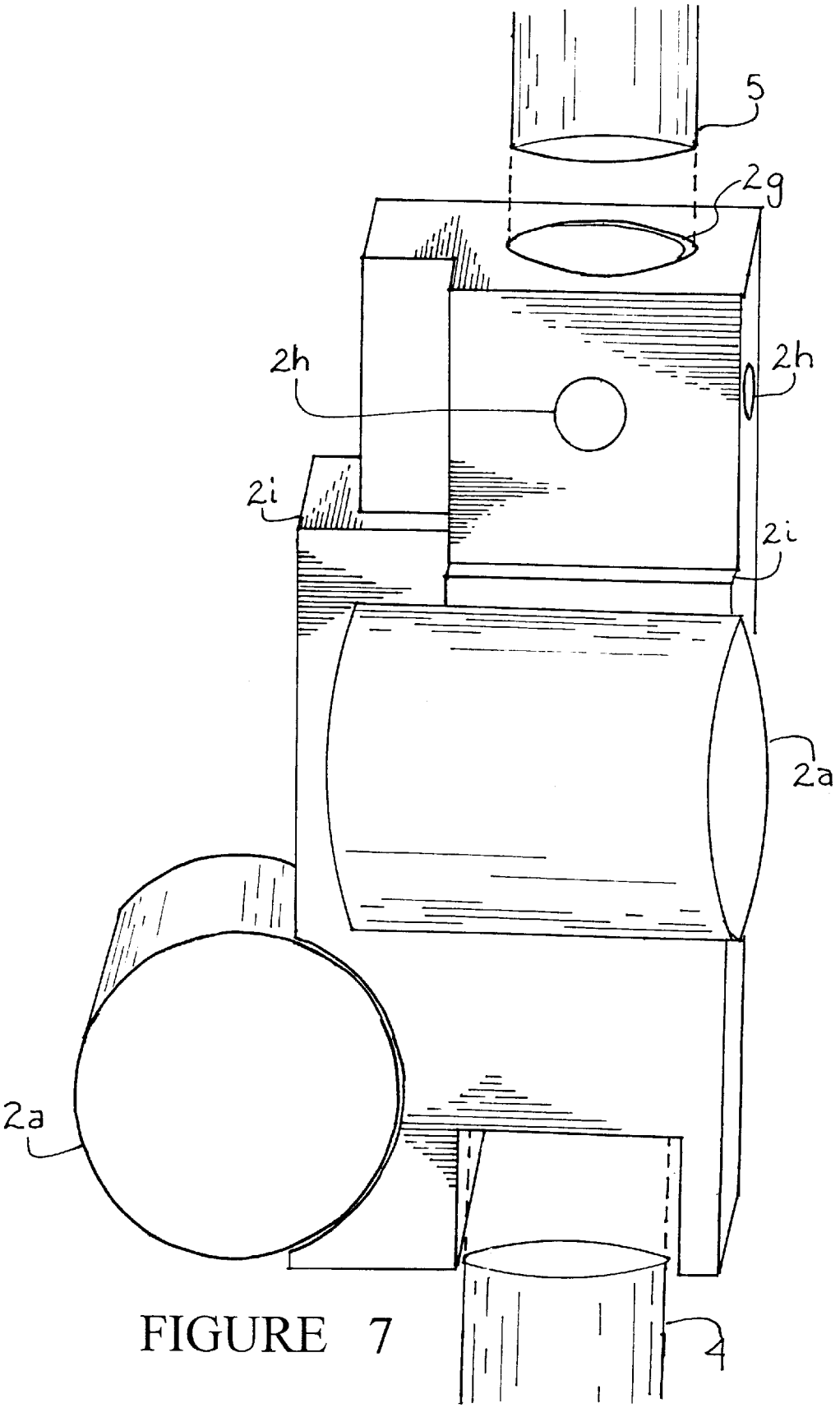
FIG. 7 interior view table frame right side front corner aligned with table leg (4) and rigid rod (5) inserted into it.
Figure 9:
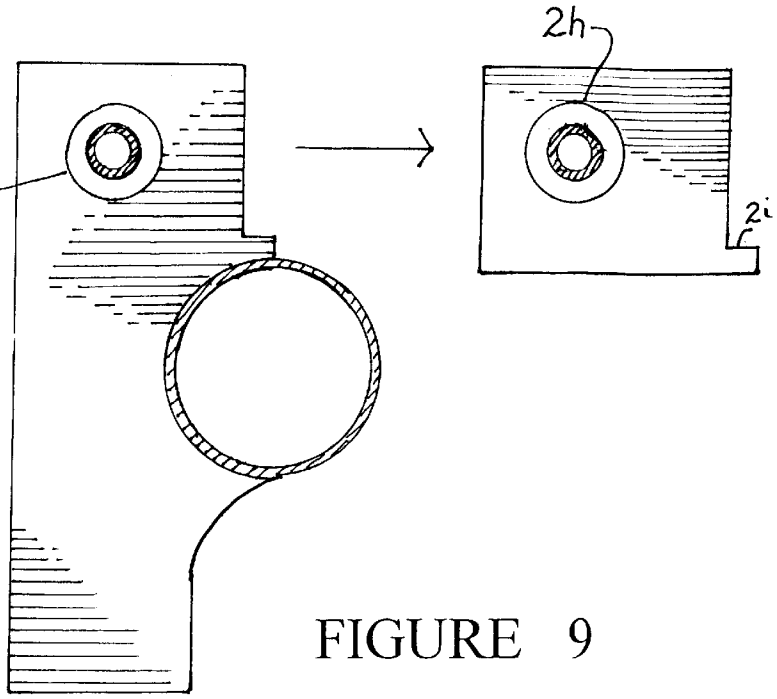
FIG. 9 detail view of top one third of a front corner separated from lower portion of itself.
Figure 8:
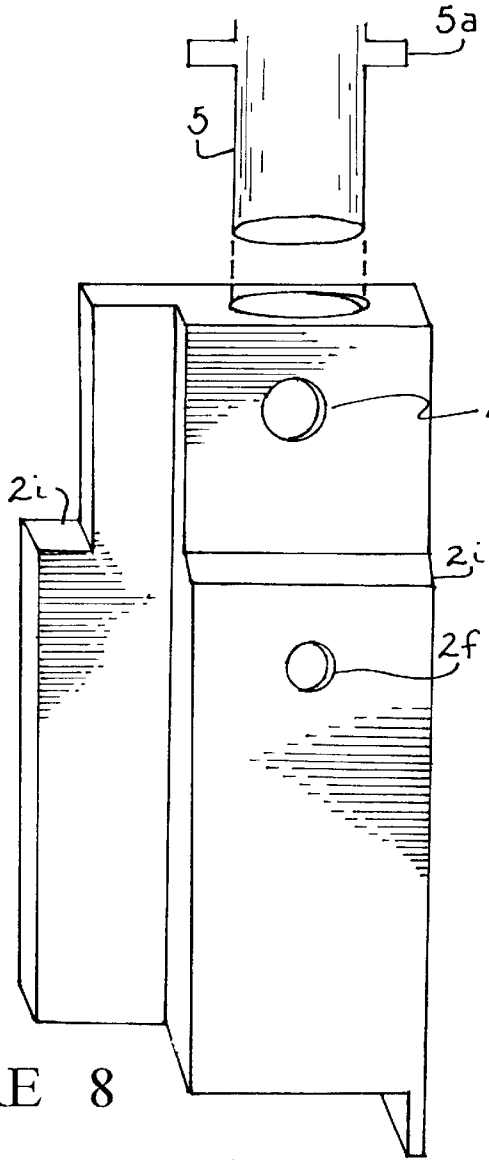
FIG. 8 interior view, table frame rear corner showing table leg (4) and rigid rod (5) inserted into it.

FIGS. 7 and 8 illustrate the forms of rectangular block shaped corner. FIG. 7 is of the front right side corner and FIG. 8 illustrates the singular rear corner form. Features common to front right, front left, and rear table frame corners are their upper third segments which are the corner segments table framing bars fasten to. These top third sections are of uniform size and shape; each provides two sills set perpendicular to one another for system components to sit upon when attached to the corners, 2*i* in FIGS. 7, 8, and 9; they provide a large exterior aperture for a tool and fastener to pass through which is aligned with a smaller aperture which allows the threaded portion of a fastener to pass through but not the fastener head thereby forming a seat for the fastener head inside of the corner, 2*h* in FIGS. 7, 8, and 9; running the full height of each corner is a vertical hollow cylinder core with a narrowed diameter ring at the top to prevent table legs from passing through the corner sockets to the demountable tabletop component above them, 2*g* in FIG. 7; all cylinder cores are of the same diameter and both telescoping and step legs insert into all corners; the top one third portion of a corner can be cut from its lower remainder to form a joint for extending the means of connecting rectangular framing bars to step legs, FIGS. 9 and 9*a; 2f* in FIG. 8 illustrates the location of the spring pin each corner provides to press against a table leg, 4, inserted into the corner, pressure from the spring pins holds the legs in place when the table is moved; each allows for a rigid tubular rod to be inserted into their vertical leg sockets from above, shown in FIGS. 7 and 8, all four corners are of the same height.

Unique to the front right and front left corners are sockets housed in the lower two-thirds segments for demountable foam rubber covered pliable or flexible steel rods. Each front corner hosts two sockets, one positioned for rod insertion from the front of the table and one positioned for rod insertion from the side of the table as illustrated by 2*a* in FIG. 7. A side view of the front facing socket can be seen in FIG. 9. Front facing rod sockets are nearer to the top of table frame. side-facing sockets are lower. This allows for the ends of a side-mounted rod and a front mounted to pass one another but not intersect with one another when both rods are used in combination to support table user needs. Corner rod sockets align with both the cul-de-sac cutouts of table frame brackets and the demountable tabletop. The cul-de-sac cutouts of the table frame brackets are the primary support for slideable couplings which secure the rods' passage through them from their socket mounting below the table top to the cubic space above it.

Parallel framing bars that form the rectangular base of the demountable frame are slotted on top, bottom, and sides. This allows for items to be attached along the length of any of the four sides of the elevated rectangle the fastened framing bars make.

Brackets of two different designs are secured to the slotted framing bars on the right, left, and front sides of the rectangular enclosure that is the frame's base, 2*c* and 2*d* in FIG. 3. Common to both bracket designs is the use of "T" shaped bolts to fasten the brackets to the slotted sides of the table frame, both brackets incorporate cul-de-sac design cutouts positioned to align with the rod sockets of the front right and left frame corners, the top surface of both types of brackets is covered with skid-resistant material to prevent the demountable table top component from sliding about when seated on the top surface of the table frame, 2*d* and 2*c* in FIG. 3.

Figure 5A:
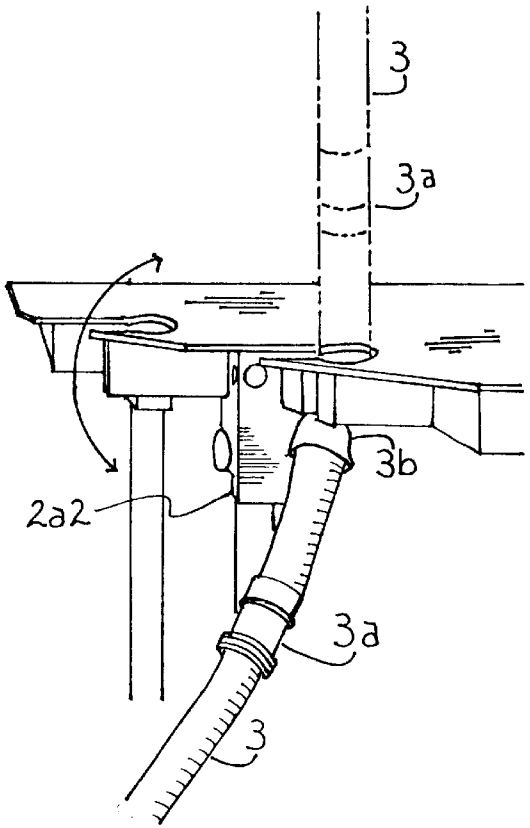
FIG. 5*a* detail view of pliable rod with slideable coupling being inserted into the front facing socket of table frame front corner, rod rotates in socket as it is elevated from below table top into service position above the table top.

Side mounted bracket design, 2*d* in FIG. 3, differs from front mounted brackets, 2*c* in FIG. 3, in that side mounted brackets do not have the L shape of the front brackets. Side mounted brackets run the length of the widthwise-framing bars. 2*d* brackets provide a surface to mount left and right side table handles to, 2*e* in FIG. 3. These handles continue the lateral extension of support for the demountable tabletop beyond the rectangular enclosure of the table frame base, 2 in FIG. 3, and provide for easy hand maneuvering of the table. The bilateral mounted front brackets, 2*c* in FIG. 3 do not run the lengthwise measure of the front framing bar. Each of these front mounted brackets is fastened to the frame at the front corners and the cul-de-sac cutout of the front bracket aligns with the front facing rod sockets of the table corners, alignment shown with rod in front facing socket position ready to be rotated from horizontal insertion position to the vertical orientation it assumes for use in the cubic space above the table top, FIG. 5*a*. Front mounted brackets, 2*c* in FIG. 3, extend frame support towards the table front and this bilateral extension is the support base for cantilevering of the tabletop component towards the user.

Figure 4:
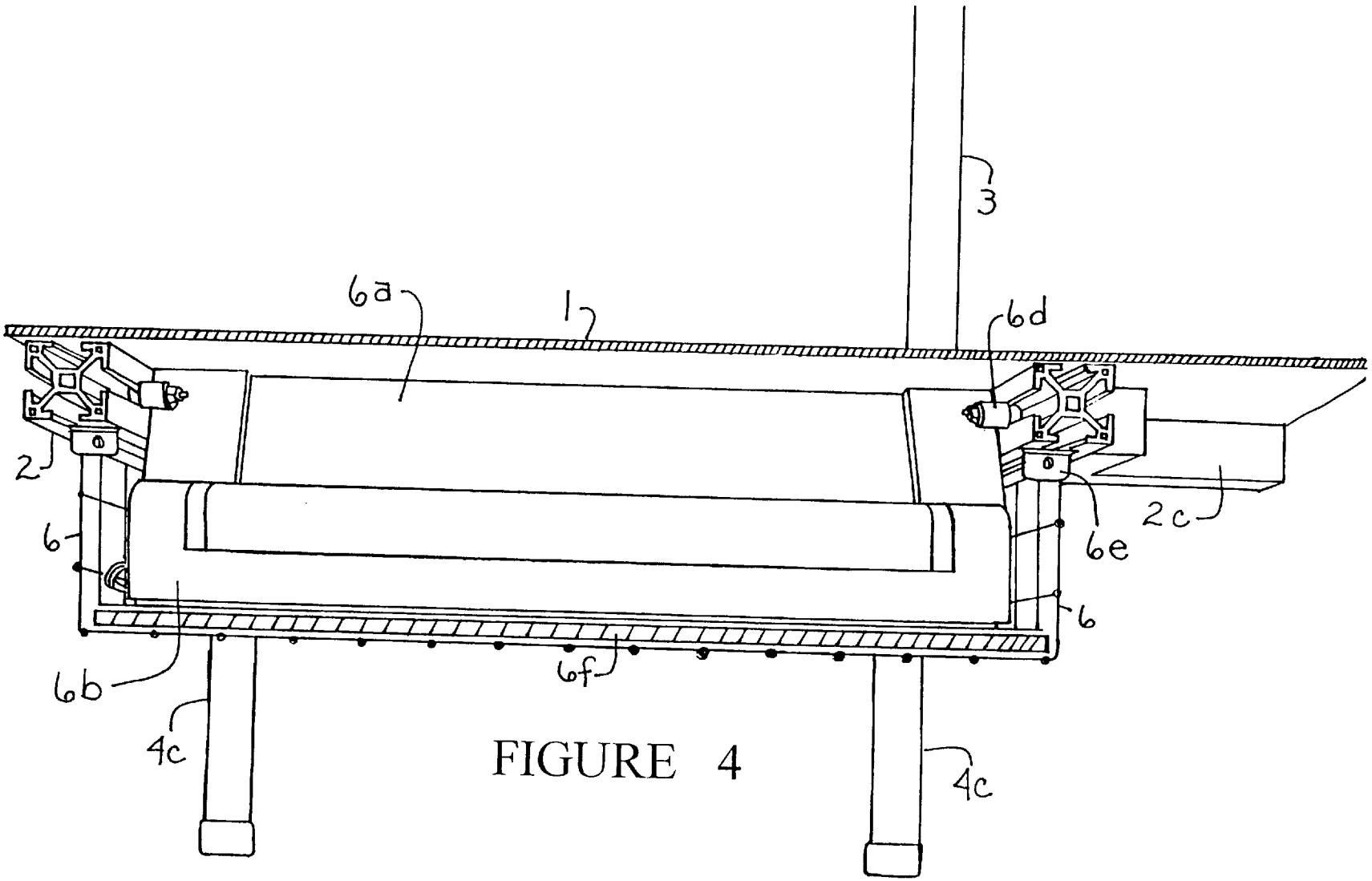
FIG. 4 cross sectional view of table frame employing step legs.

The interior space of the frame's rectangular base encloses a plastic covered wire mesh housing for the low wattage florescent light fixtures, 6 in FIG. 3. Light diffusing joists to support the midline area of the demountable table top component transverse the base frame at midline, 6*a* in FIGS. 3 and 4. 6*e* in FIG. 4 shows the fastener that secures the wire mesh housing to the bottom slot of the framing bar. 6*d* shows the "T" bolt fastener used to secure the joists to the interior side slots of the lengthwise framing bars. 6*b* is a low wattage portable florescent fixture. All fixtures in the present embodiment are the same. A plurality of fixtures may be employed. 6*c* shows Velcro strips attached to the top surface of the rigid platform base, 6*f,* of the wire mesh enclosure housing the light fixtures. Velcro stripping secures the fixtures to the rigid base. 8 in FIG. 3 illustrates a frame mounted wire carrier to convey fixture cords to 7 which is a three plug polarized outlet secured to the bottom slot of the framing bar.

Figure 1:
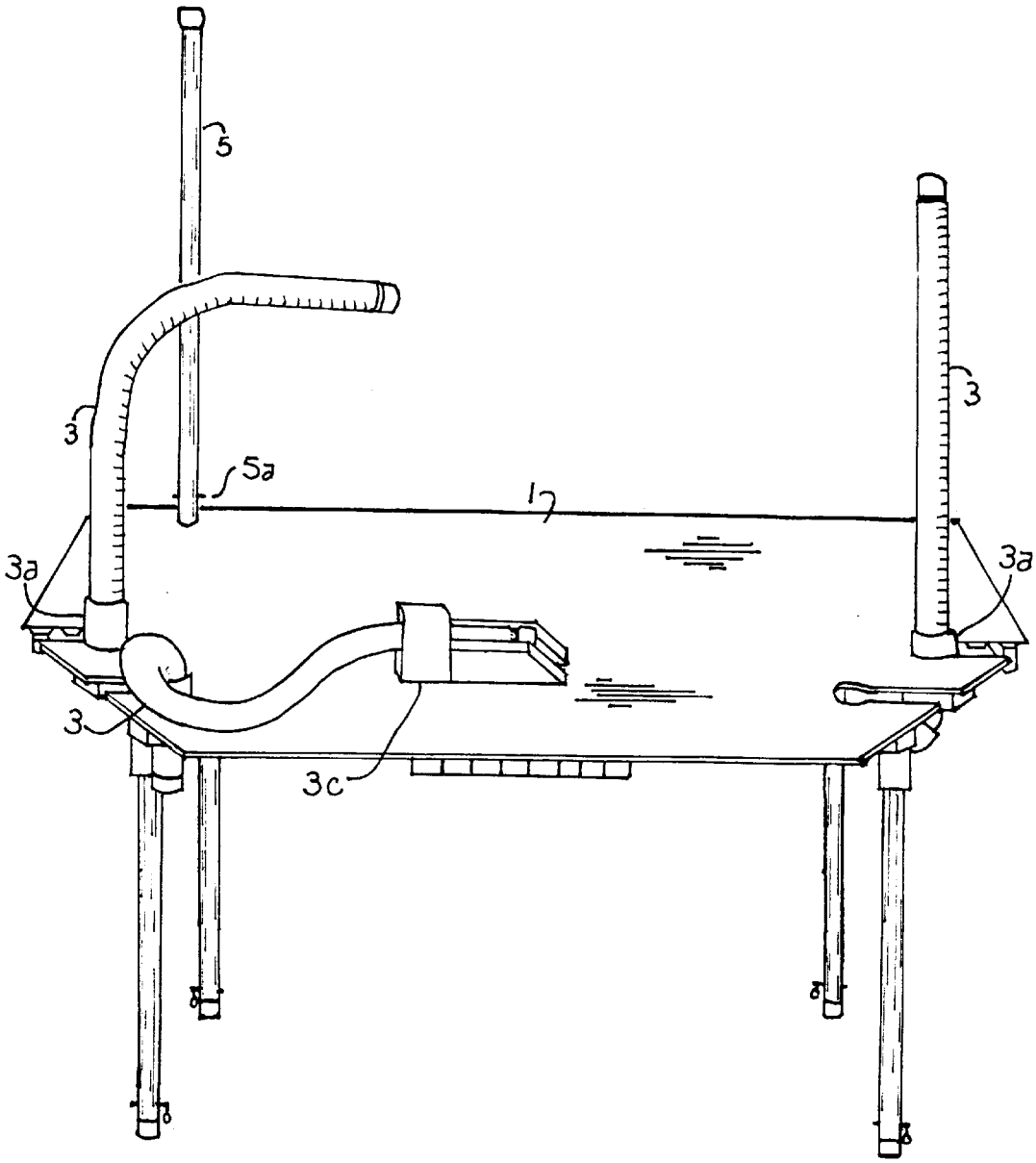
FIG. 1 front perspective view of invention.

A symmetrical light diffusing tabletop, 1 in FIGS. 1 and 2, is comprised of laminated materials: a rectangular and demountable rigid sheet base is laminated to a plurality of light diffusing surface "skin" materials. Tabletop sides are symmetrically tapered towards the front side edge that is of greater length. A plurality of cul-de-sac cutouts arc symmetrically positioned along the top's tapered segments; a plurality of circular cutouts are positioned where the tabletop covers the table frame's rear corners providing access to rear table frame corners' top side apertures. On the tabletop's underside a transparent plastic hinge transverses the length of the tabletop from front to rear allowing the rigid top to fold at midline, 1*d* in FIG. 2. A non-folding tabletop component of all the same characteristics is another embodiment of the present design. An opaque embodiment of the tabletop component is an alternative when the intended user is blind and unable to benefit from the addition of underlighting to the table; in this circumstance the lighting components may also be deleted from the invention.

1*a* in FIG. 2 shows the cul-de-sac cutouts which provide passage and support for foam rubber covered rods to assume position in the cubic space above the tabletop. 1*b* in FIG. 2 illustrates the bilateral tapering of the tabletop's sides towards the table's front side edge of greater length. The taper design reduces the square footage the table consumes, allows for direct hand-over-hand assistance to be given to the table user's shoulders, arms, and hands, and allows for peers to be closer to the table occupant. This design combines with the table system's flexible height adjustment so that the substantial flat surface of the top can be positioned between waist and shoulder levels. Height adjustability of the table surface and the limited range of motion needed to reach across the entire longitudinal midline of this tabletop are this system's means of facilitating eye-hand motor control; it recommends this presentation in place of the common adaptive furniture practice of attempting to facilitate eye-hand control by "wrapping" the table around the seated occupant at waist level.

Figure 5:
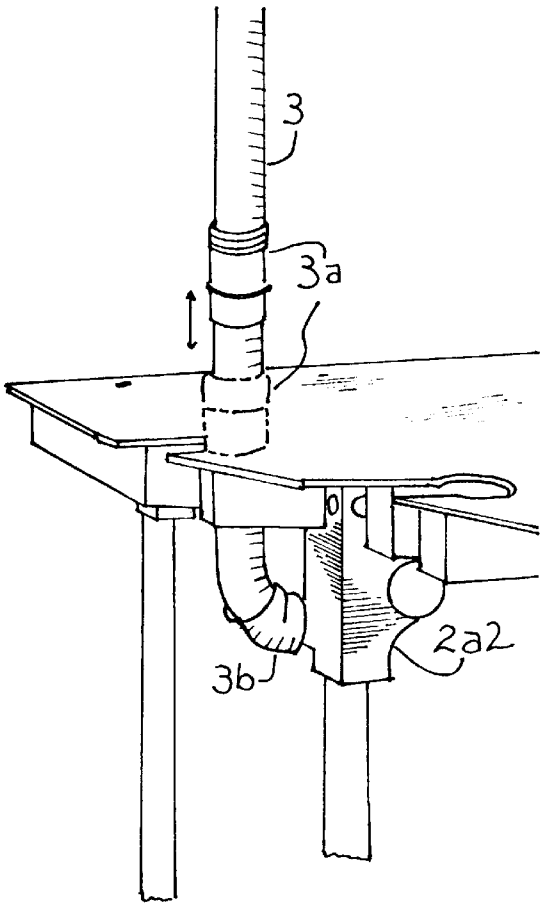
FIG. 5 detail view of pliable rod with slideable coupling being inserted into the side facing socket of table frame front corner.
Figure 12:
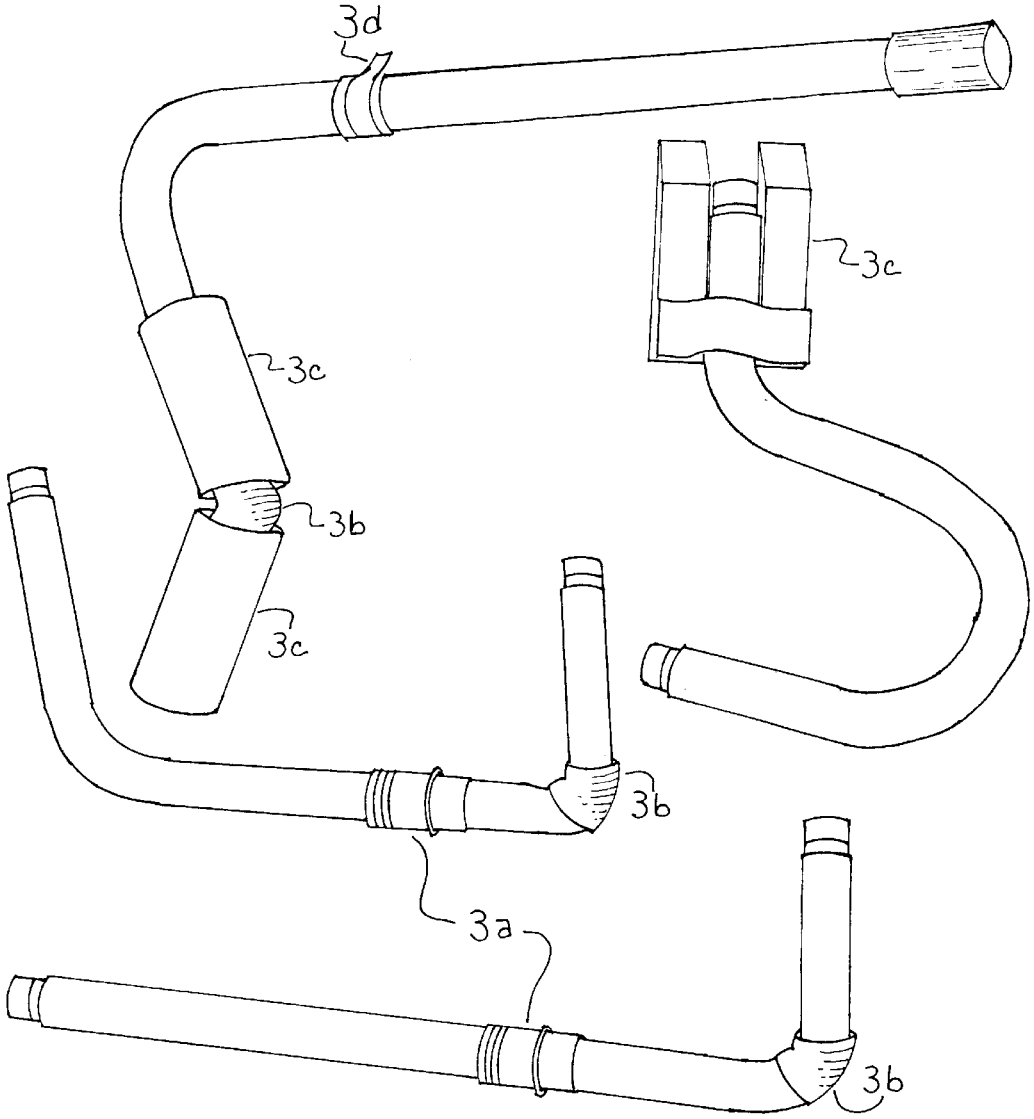
FIG. 12 demountable rods with samples of materials used to customize rods for individuals and tasks.

FIG. 12 displays a plurality of foam rubber covered pliable steel rods. Rods are comprised of concentric laminations of tubular material around an inner core rod of variable pliability resulting in rods that offer variable resistance to pressure and weight. Rods are secured in position as they pass through the tabletop by means of slideable couplings, 3*a* in FIGS. 5 and 5*a*. FIGS. 5 and 12 identify the components of a slideable coupling: 3*a*1 is the ringed upper segment which is of a diameter wider than its aligned cul-de-sac cutouts, 3*a*2 is the bottom section of the slideable coupling which is of a lessor diameter than aligned cul-de-sac cutouts and inserts down through them; the cul-de-sac openings becoming a second socket mount for the rods as viewable in FIGS. 5. 5*a,* and 6. 3*a*1, the top section of slideable couplings is of variable height. Taller couplings provide additional rod support when a more pliable rod extends vertically for a distance above the tabletop surface and therefore is subject to greater leverage than rods which assume a bend closer to the tabletop surface. Rod length is variable.

Figure 6:
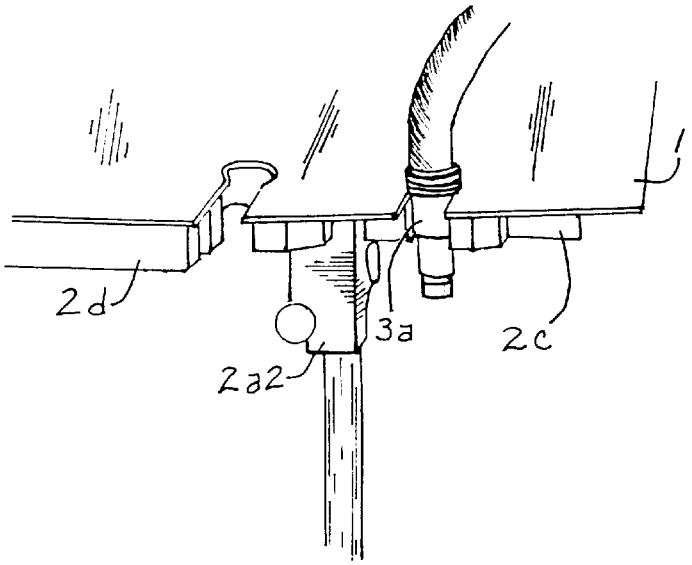
FIG. 6 detail view of pliable rod employing secured slideable coupling as a pivot to swivel into varying positions above the table top, when not inserted into a table corner socket rod is free to rotate clockwise or counterclockwise in its pivot.
Figure 1A:
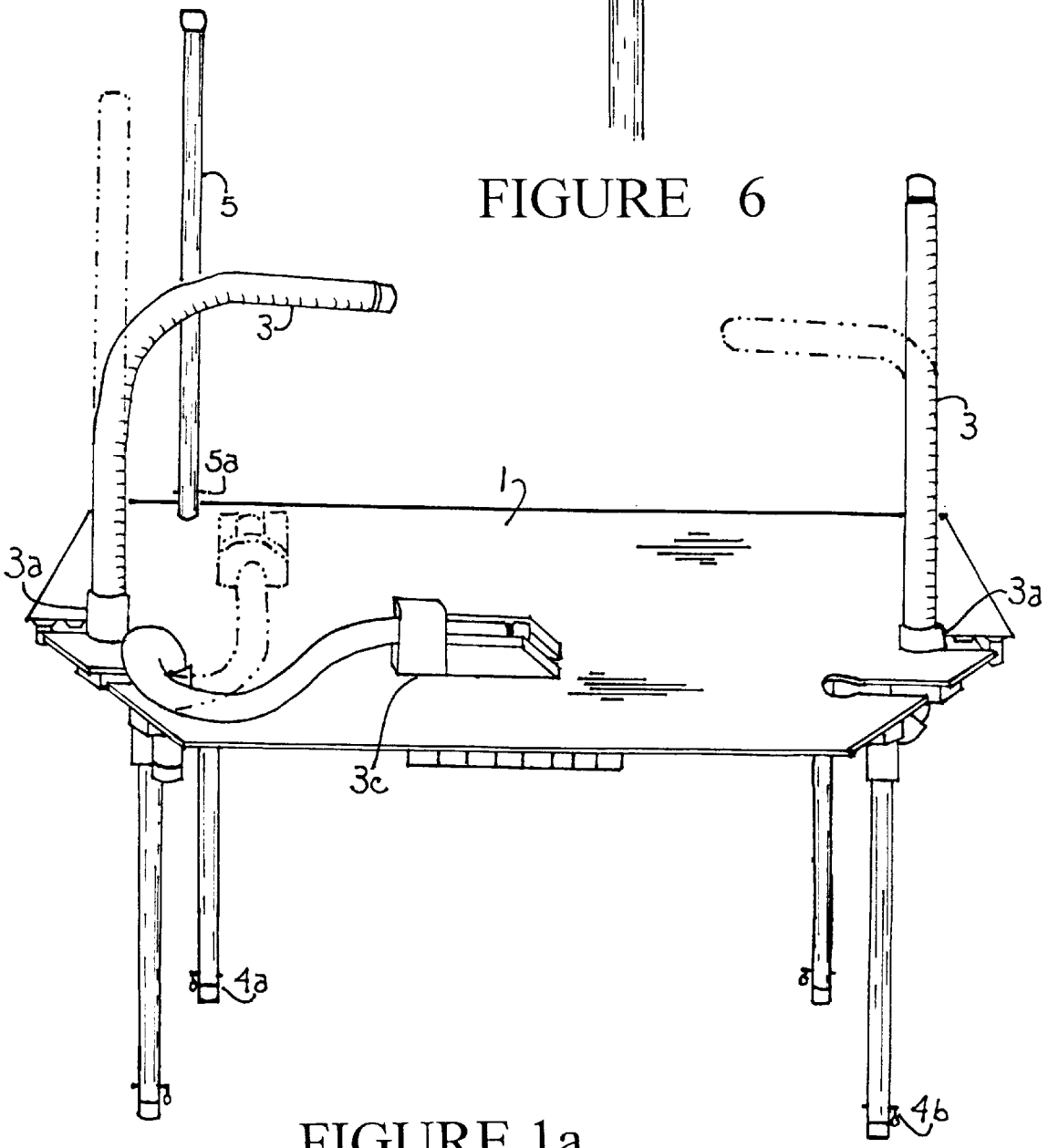
FIG. 1*a* illustration of flexibility in rod positioning and a sample rod customization FIG. 2 perspective views of demountable tabletop.

Rod insertion into the table frame corner sockets provides rods resistance to being rotated by pressures applied to them in usage and corner sockets prevent downward slippage of rods due to weight directed downward on them. Rod customization is by addition of a plurality of foam rubbers of varying pliability to the rod's outermost lamination as shown in 3*c* of FIGS. 1*a* and 6. These figures show an alternative means of managing downward pressures on the rods. Rod 3*c* in FIG. 1*a* is shown in a position to support left shoulder elevation movements. Its rigid foam rubber base has skid-resistance material adhered to its underside and in this articulation it allows the user to apply downward pressure to the rod in a manner that is transferred directly to the tabletop surface. Therefore rod 3*c* does not need to be inserted into a frame corner socket; it only requires its slideable coupling to be inserted into the aligned cul-de-sac sockets of bracket and tabletop. Without insertion into the corner socket this rod is free to be swiveled into and out of position for quick exit by the occupant from the table. It's slideable coupling socket operating as a pivot to pivotably interconnect with rod 3*c* to rotate clockwise or counterclockwise and to slide up and down or vertically. This invention anticipates attachment of a motorized device to a slotted side of the table's framing and the downward extending end of a pivoting rod to make the rod move at specific intervals.

FIG. 5 shows a side mounted rod being inserted into its corner socket and aligned cul-de-sac openings. 3*b* in FIG. 5 shows an angle constructed of rigid material applied to the outermost lamination of a pliable rod where it functions as a fixed angle bend in the rod. Illustrated is the usage of a fixed angle bend to limit travel of the rod into the socket opening. 3*c* in FIG. 12 illustrates two types of foam rubber covering applied to the customization of rods depending on rod function: the light value rigid foam being applied to direct weight bearing from arm and hands and the darker value foam rubber indicates a dense, soft foam rubber for chin contact when rods are used for head support.

Application of any rod materials for support of neck and head is by prescription only and requires consultation with an orthopedic physician and physical therapist.

A plurality of demountable rigid rods, 5 in FIGS. 1, 7, and 8 serve for heavy weight bearing tasks and can be used as devices to pull against for therapeutic exercises and for shifting body weight to change position. Rigid rods insert into their corner sockets by passing downwards through a plurality of circular holes in the demountable table top, 1*c* in FIG. 2, and into the cylinder cores of rear frame corners. Rigid rod diameter is less than that of table legs and therefore a rod will slide downward inside of a table leg occupying a frame corner's hollow cylinder core, the table leg having been inserted into the core though the corner's bottom side aperture. A frame corner's cylinder core can support both the lessor diameter sliding segment of a telescoping leg and a rigid rod. The rigid rod extending above the tabletop surface and the inner segment of the telescoping leg are interchangeable system components. 5*a* is a stop to limit descent of the rigid rod into the corner socket.

Figure 13:
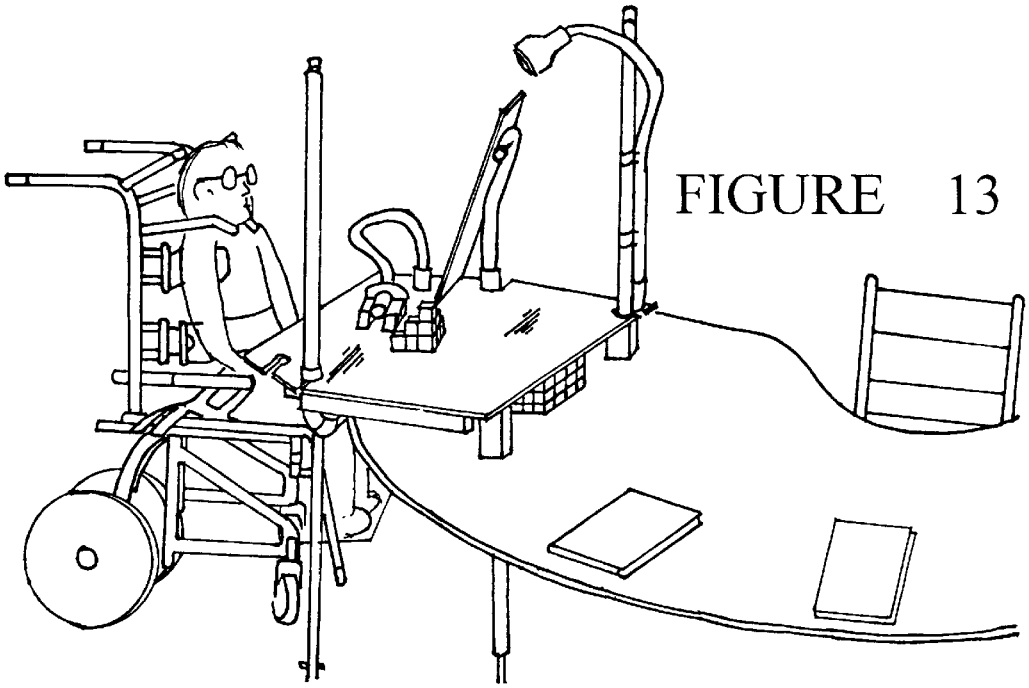
FIG. 13 side view of table frame supported by classroom table: telescoping legs are inserted into front frame corner sockets, vertical rigid rod is inserted into rear frame corner socket.

Corner design enables all demountable table system components to be functional regardless of the form of demountable table frame support available—telescoping legs, steps legs, a combination of both leg forms, or no legs with the table frame supported by the surface it rests on. Functional elements include low wattage lighting, customizing of wire mesh enclosure with rigid platform base for secure storage of high use items, demountable rods, rigid rods. FIGS. 1 and 1*a* show a free standing table supported by telescoping legs. These legs can be incrementally increased and decreased in length by means of a locking pin that sets the extended length of the telescoping inner leg segment, thereby heightening and lowering the demountable table frame. FIG. 4 shows step legs in front and rear corner positions supporting the demountable table frame. Step legs can be cut to any size to allow for customized height positioning of the demountable table frame. FIG. 13 shows the front corners of the demountable frame supported by height adjustable telescoping legs and the rear corners and plastic coated wire mesh enclosure supported by a classroom table. The demountable frame can rest on the top of other furniture without use of any of its legs; in all these situations all user enabling functions are maintained and available to the user as illustrated in a user's perspective view, FIG. 14.

Figure 10A:
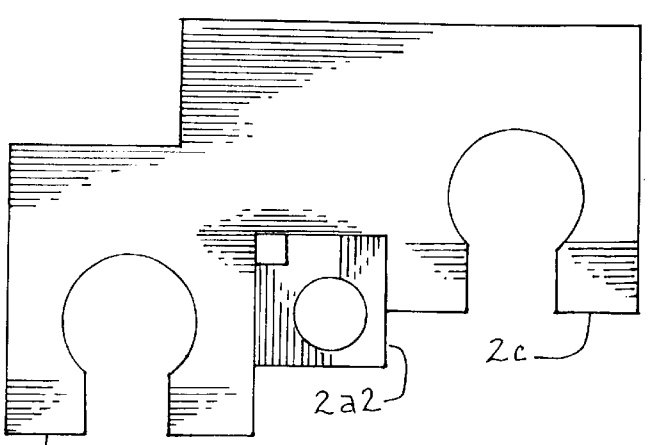
Figure 10:
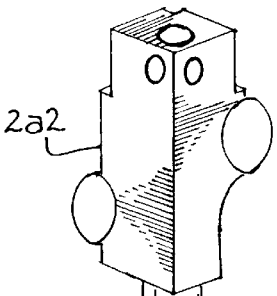
FIG. 10 step leg supporting independent use of front corner.
Figure 10:
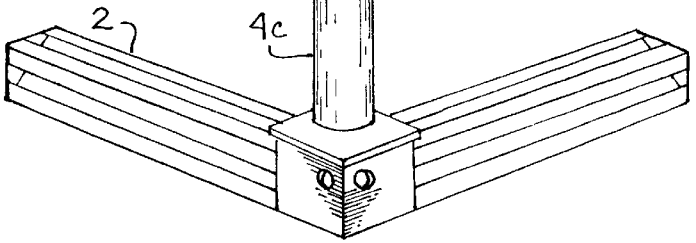
Figure 9A:
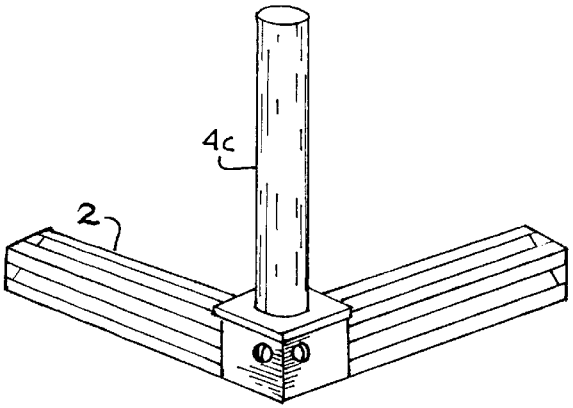
FIG. 9*a* detached corner segment shown expanding the opportunities to join segments of table framing to a step leg in planes other than that directly supporting the tabletop.
Figure 11:
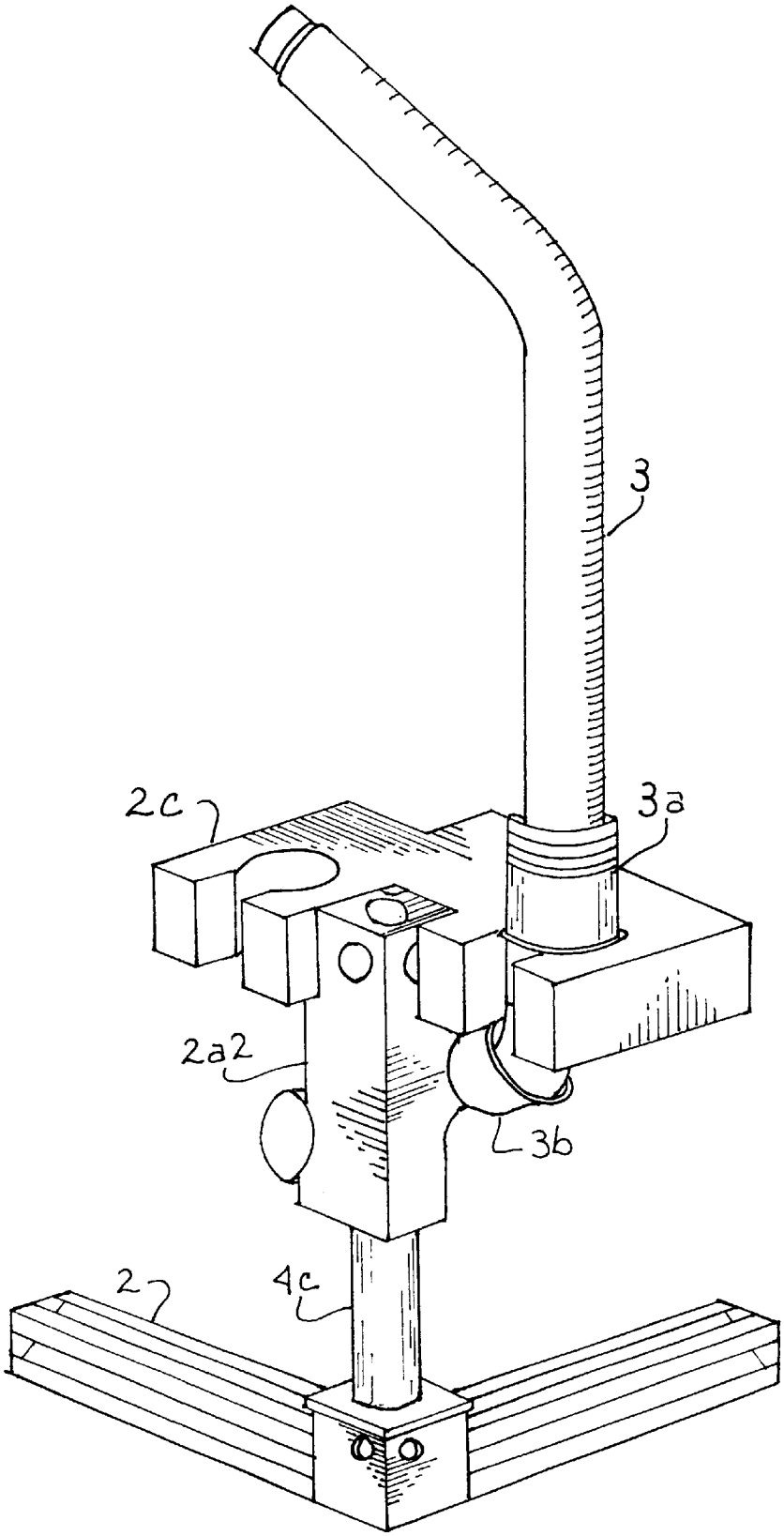
FIG. 11 demountable front corner employed for independent mounting of pliable rods.

Front corners are independently demountable and can be supported by the joining of a step leg to framing bar components as shown in FIG. 9*a*. FIG. 10 illustrates this means of independently mounting a front corner to a step leg. The slotted sides of the framing bar components allow for counterweight material to be added to this assembly as well as other items which can utilize the slots for attachment to this support base. The corner's upper third segment's interior fastener seats and sills provide a means for attaching cul-de-sac segments from demountable brackets, 2*c* in FIG. 3, directly to the corner, FIG. 10*a*. Corner sockets support pliable rod attachment to the corner. Bracket cul-de-sacs continue this support by serving as sockets for slideable couplings in exactly the same manner as when used with the table proper. Demountable corners on an independent support base provide a pair of pliable foam rubber covered steel rods to the cubic space above any substantial flat surface, FIG. 11. Rods can be customized in the same manner as when working in conjunction with the system's demountable rigid surface top.

Figure 14:
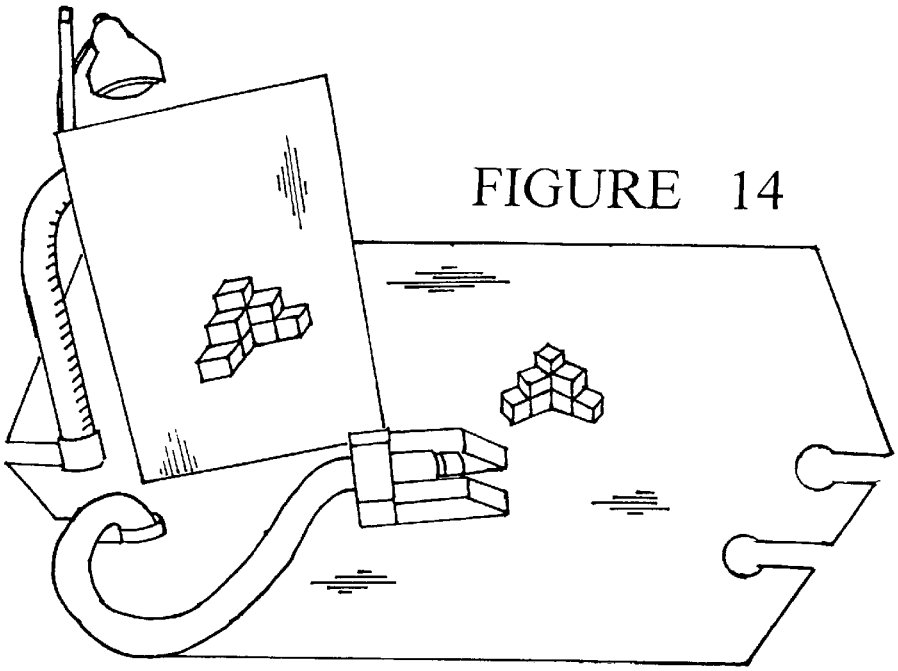
FIG. 14 user's perspective of table frame as employed in FIG. 12.

Rods can be bent into a desired configuration to assist the postural stability of the occupant. FIGS. 13 and 14 illustrate a combination of table features as would be applied by an occupant. The rigid vertical rod supports a light fixture, which supplies key lighting to the tabletop and illuminates a light diffusing rigid sheet of plastic that holds an outline drawing of the blocks assembled on the tabletop. In this manner diminished vision is aided by enhanced viewing angle and multiple source lighting. The rod with a rigid foam rubber support attached to it is positioned to provide support for left shoulder and upper arm movements. Both types of assist being characteristic of the needs of an individual challenged by cerebral palsy.

The lightweight and easy maneuverability of the table system and its lack of interference assist versatile usage in the passageways and flow of movement in the classroom by other students. Vital to the success of any piece of adaptive furniture is its ability to provide for individual need while promoting group involvement: the adaptive appliance must not consume the space around itself by blocking the sightlines of others, must not be too heavy to be moved other than by coasters, and must not have poor or no height correspondence with other furnitures in the environment, etc. The operation of this demountable component table system advances prior art in all these functional necessities.

I claim:

1. An independent device for supporting a plurality of rods over a substantially flat surface comprising:

a bracket with a plurality of cut-outs;

a frame assembly having an upper section and a lower section, wherein said upper section is a table front corner, and wherein said frame assembly has a plurality of sockets in said lower section of said frame assembly;

a step leg connecting with said frame assembly on a first end and connecting to a supporting stand on a second end;

a plurality of attachable flexible rods extending from said frame assembly, wherein said flexible rods are secured to said bracket by a slidable coupling at said cut-outs and secured to said lower section of said frame assembly by said sockets.

2. A demountable table system, comprising:

a symmetrical and substantially flat table top surface having a rear edge, a front edge, and two side edges, and wherein said table top surface has a plurality of cut-outs;

a generally rectangular demountable table frame with four table frame corners interconnected to four table frame members, wherein said table frame corner s have a lower section and an upper section with a plurality of sockets housed within said lower section, and wherein said table top surface is secured to said table frame; and a plurality of attachable flexible rods extending above said table top surface with slidable couplings securing said rods at said cut-outs.

3. The demountable table system according to claim 2, further comprising a means of vertically adjusting a height of said table top surface.

4. The demountable table system according to claim 3, wherein said means of vertically adjusting a height is a plurality of telescoping legs extending downwards from said table frame corners with a locking means for securing each said telescoping leg at a desired height.

5. The demountable table system according to claim 3, wherein said means of vertically adjusting a height is a plurality of fixed length step legs extending downwards from said table frame corners.

6. The demountable table system according to claim 3, wherein said means of vertically adjusting a height is a pair of telescoping legs extending downwards from said table frame corners with a locking means for securing each said telescoping leg at a desired height and a pair of step legs supporting said demountable table frame.

7. The demountable table system according to claim 3, wherein said means of vertically adjusting a height is a telescoping leg extending downwards from each of said table frame corners with a locking means for securing each said telescoping leg at a desired height.

8. The demountable table system according to claim 2, wherein said cut-outs are bilateral cul-de-sac cut-outs.

9. The demountable table system according to claim 2, wherein said flexible rods are composed of steel.

10. The demountable table system according to claim 2, further comprising a plurality of foam rubber attachments connected to said flexible rods.

11. The demountable table system according to claim 2, wherein said flexible rods have fixed angular bends.

12. The demountable table system according to claim 2, wherein said flexible rods pivotably interconnect with said cut-outs in said table frame corners.

13. The demountable table system according to claim 2, further comprising a circular hole in said table top at a rear corner of said rear edge and an attachable rigid rod extending through said circular hole and interconnected to a socket of said table frame corners.

14. The demountable table system according to claim 2, wherein said table top surface is cantilevered and tapered at said front edge.

15. The demountable table system according to claim 2, further comprising a lighting system beneath said table top, wherein said table top is light diffusing.

16. The demountable table system according to claim 2, further comprising a pair of side brackets attached to each side of said table frame, wherein said side brackets provide a handle mount base, and wherein said side brackets have bracket cut-outs aligned with said cut-outs of said table top.

17. The demountable table system according to claim 2, further comprising a pair of L shaped brackets attached to said table frame corners located below said front edge of said table top, and wherein said L shaped brackets have bracket cut-outs aligned with said cut-outs of said table top.

18. The demountable table system according to claim 2, wherein said flexible rods are assembled of concentric laminations with a means of manufacturing rods of different flexibility.

19. The demountable table system according to claim 2, further comprising a midline hinging means running transversely from said front edge of said table top to said rear edge of said table top allowing said table top to be folded.

* * * * *